US007346291B2

(12) United States Patent
Kim et al.

(10) Patent No.: US 7,346,291 B2
(45) Date of Patent: Mar. 18, 2008

(54) TONER SEALING ELEMENTS FOR DEVELOPING DEVICE AND IMAGE FORMING APPARATUS HAVING THE SAME

(75) Inventors: Young-min Kim, Suwon-si (KR); Su-in Lee, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 302 days.

(21) Appl. No.: 11/199,208

(22) Filed: Aug. 9, 2005

(65) Prior Publication Data

US 2006/0045563 A1 Mar. 2, 2006

(30) Foreign Application Priority Data

Aug. 26, 2004 (KR) ..... 10-2004-0067530

(51) Int. Cl.
*G03G 15/08* (2006.01)

(52) U.S. Cl. ..... 399/103; 399/105

(58) Field of Classification Search ..... 399/102, 399/103, 105

See application file for complete search history.

(56) References Cited

U.S. PATENT DOCUMENTS 5,502,547 A * 3/1996 Shirai ..... 399/102
6,834,170 B2 * 12/2004 Choi et al. ..... 399/103
7,076,185 B2 * 7/2006 Okamoto ..... 399/103
7,206,535 B2 * 4/2007 Nozawa ..... 399/103

FOREIGN PATENT DOCUMENTS

| | | |
|---|---|---|
| JP | 06-313996 | 11/1994 |
| JP | 2002-189399 | 7/2002 |
| KR | 1020030092320 | 12/2003 |

* cited by examiner

*Primary Examiner*—William J. Royer
(74) *Attorney, Agent, or Firm*—Staas & Halsey, LLP

(57) ABSTRACT

A developing device and an image forming apparatus having the same are provided. The developing device includes: a housing, which is formed by coupling an upper case and a lower case and in which a developing roller and a regulating blade are installed; sealing elements, which are respectively formed at both sides of the developing roller or the regulating blade and prevent toner from leaking out of the housing; and fixing elements, which fix the sealing elements in the housing so that the sealing elements cannot move. Each of the fixing elements includes a supporting element, which expands the area of a corresponding fixing element and supports the corresponding sealing element by pushing the corresponding sealing element toward the regulating blade and the developing roller so that the corresponding sealing element comes into contact with the regulating blade and the developing roller.

12 Claims, 6 Drawing Sheets

TONER SEALING ELEMENTS FOR DEVELOPING DEVICE AND IMAGE FORMING APPARATUS HAVING THE SAME

CROSS-REFERENCE TO RELATED APPLICATIONS

This application claims the benefit of Korean Patent Application No. 10-2004-0067530, filed on Aug. 26, 2004, in the Korean Intellectual Property Office, the disclosure of which is incorporated herein in its entirety by reference.

BACKGROUND OF THE INVENTION

1. Field of the Invention

The present invention relates to an image forming apparatus, and more particularly, to an image forming apparatus having a developing device which develops an electrostatic latent image into a toner image.

2. Description of the Related Art

Typically, a liquid electrophotographic printer forms an electrostatic latent image on a photosensitive medium, such as a photosensitive belt or a photosensitive drum, develops the electrostatic latent image with a developing agent having a predetermined color, and transfers the developed electrostatic latent image onto a recording sheet, thereby obtaining a desired image.

The electrophotographic printer is largely classified into either a liquid or dry electrophotographic printer depending on the type of developing agent that the electrophotographic printer uses. The liquid electrophotographic printer uses a liquid developing agent, which is a liquid carrier mixed with powder toner. The dry electrophotographic printer uses a heterogeneous developing agent, which is a mixture of a powder carrier and powder toner, or a homogeneous developing agent composed of powder toner. The dry electrophotographic printer will be described more fully in the following as an example of the electrophotographic printer, under the assumption that the electrophotographic printer uses toner as a developing agent.

The electrophotographic printer includes a developing device, which turns an electrostatic latent image into a toner image. The developing device is formed as an assembly which can be attached to and detached from a main body of the electrophotographic printer.

FIG. 1 is a front view of a conventional developing device, FIG. 2 is a longitudinal sectional view of the conventional developing device, and FIG. 3 is an enlarged view of a portion of the conventional developing device when a sealing element is separated from a photosensitive drum 9 forming an empty space therebetween.

Referring to FIGS. 1 and 2, the conventional developing device includes a developing roller 12*d*, which is rotatably supported by a lower frame 15, is in contact with the photosensitive drum 9, and develops an electrostatic latent image formed on the photosensitive drum 9 with toner, a regulating blade 12*e*, which is installed above the developing roller 12*d* in a holder 12*e*1 and regulates the thickness of a toner layer attached on the developing roller 12*d*, and the sealing element, which is installed at either side of the developing roller 12*d* or the regulating blade 12*e* and hermetically seals a space between the developing roller 12*d* and the regulating blade 12*e* so that toner is prevented from leaking from inside the conventional developing device.

The sealing element is comprised of a main sealing element S4, which is installed at either end of the developing roller 12*d* and contacts the surface of the developing roller 12*d*, and an auxiliary sealing element S7, which is installed on the main sealing element S4. The sealing element is formed of an elastically deformable material such that it is easily deformed when an external force is applied thereto.

When the main sealing element S4 seals the space between the developing roller 12*d* and the regulating blade 12*e*, the main and auxiliary sealing elements S4 and S7 contact one side of the regulating blade 12*e* because the regulating blade 12*e* is installed in contact with the developing roller 12*d*. Accordingly, the main sealing element S4 may contact one side of the regulating blade 12*e* as well as the surface of the developing roller 12*d*.

When the main sealing element S4 is installed at either end of the developing roller 12*d*, it comes into direct contact with a bent portion 12*e*', which is an end of the regulating blade 12*e*, and is pushed in a direction marked by "B" of FIG. 3 by a predetermined distance due to friction therebetween.

During developing an electrostatic latent image formed on the photosensitive drum 9 with toner, the regulating blade 12*e* moves back and forth in a direction marked by "A" of FIG. 3 to regulate the thickness of a toner layer attached on the surface of the developing roller 12*d*, and the main sealing element S4 is pushed in the direction marked by "B". Accordingly, an empty space P is formed between the developing roller 12*d* and the main sealing element S4. The empty space P may also be formed between the developing roller 12*d* and the main sealing element S4 due to external shock.

Toner removed from the surface of the developing roller 12*d* by the regulating blade 12*e* may be undesirably discharged to the outside of the conventional developing device via the empty space P polluting a corresponding electrophotographic printer or a user's surroundings.

SUMMARY OF THE INVENTION

The present invention provides a developing device which prevents toner from leaking out of the developing device, even when a developing roller and a regulating blade are separated from a sealing element in the middle of a developing operation or due to external shock.

According to an aspect of the present invention, there is provided a developing device including: a housing, which is formed by coupling an upper case and a lower case and in which a developing roller and a regulating blade are installed; sealing elements, which are respectively formed at both sides of the developing roller or the regulating blade and prevent toner from leaking out of the housing; and fixing elements, which fix the sealing elements in the housing so that the sealing elements cannot move. Each of the fixing elements includes a supporting element, which expands the area of a corresponding fixing element supporting a corresponding fixing element and supports the corresponding sealing element by pushing the corresponding sealing element toward the regulating blade and the developing roller so that the corresponding sealing element comes into contact with the regulating blade and the developing roller.

BRIEF DESCRIPTION OF THE DRAWINGS

The above and other features and advantages of the present invention will become more apparent by describing in detail exemplary embodiments thereof with reference to the attached drawings in which like reference characters designate the same or similar parts throughout the figures thereof.

DESCRIPTION OF THE EMBODIMENTS

Figure 1:
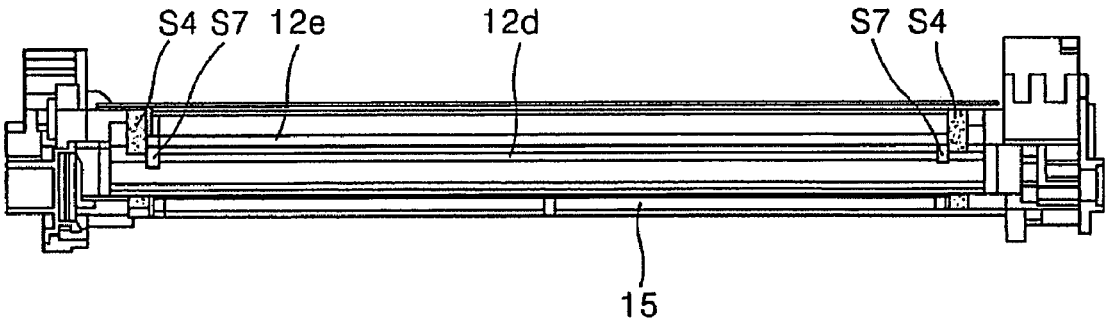
FIG. 1 (PRIOR ART)
FIG. 1 is a front view of a conventional developing device.
Figure 2:
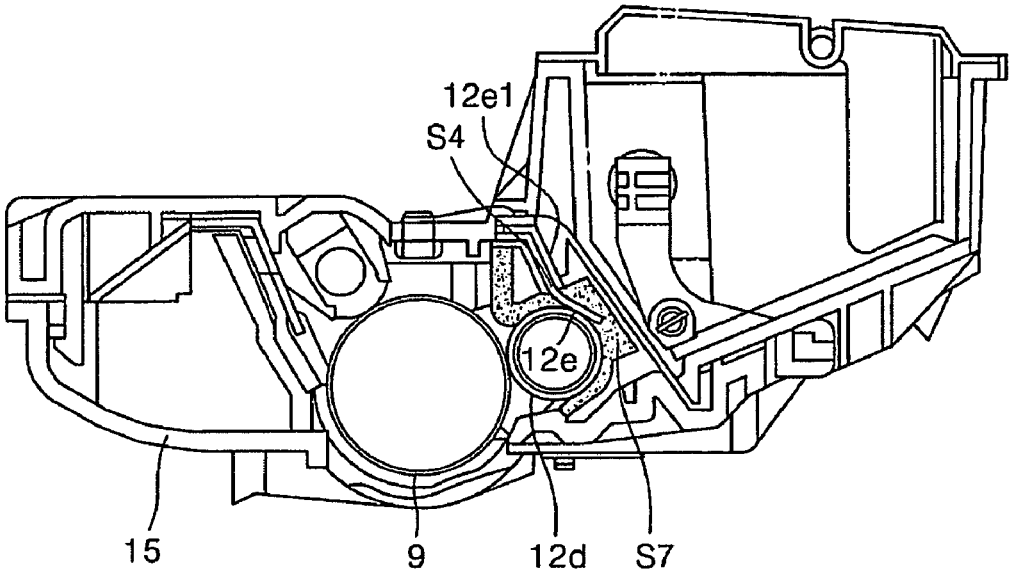
FIG. 2 (PRIOR ART)
FIG. 2 is a longitudinal sectional view of the conventional developing device of FIG. 1.
Figure 3:
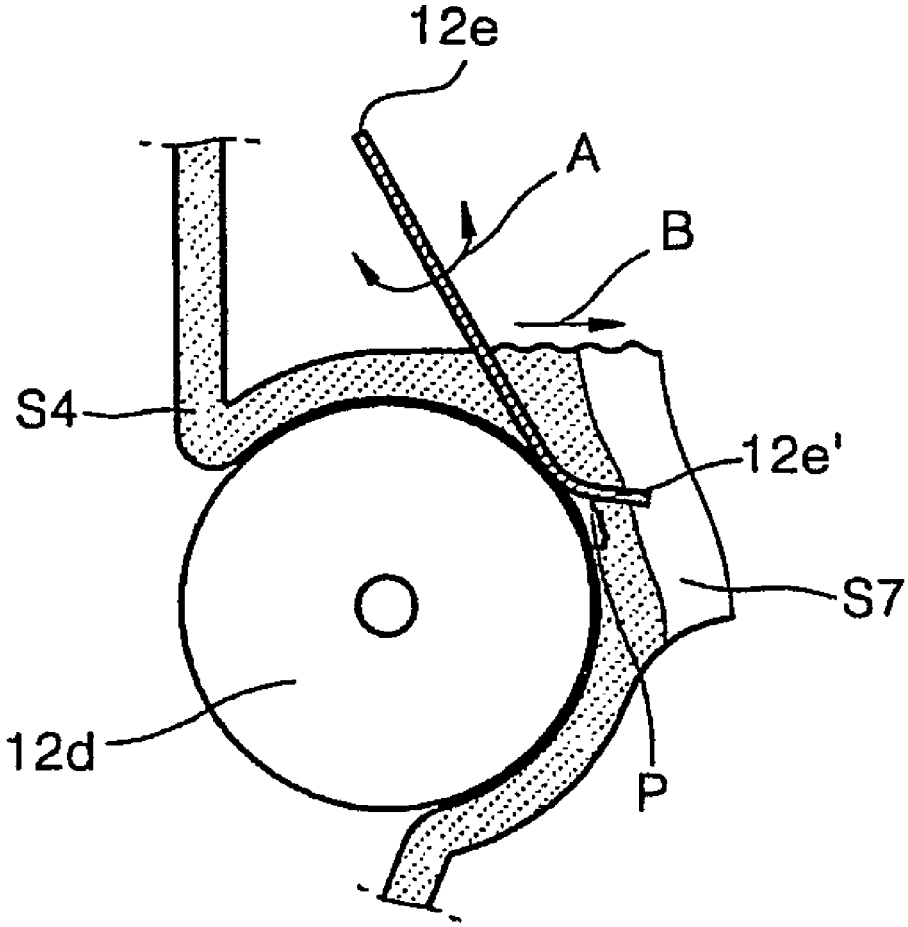
FIG. 3 (PRIOR ART)
FIG. 3 is an enlarged view of a portion of the conventional developing device of FIG. 2 when a sealing element is detached from a photosensitive drum.
Figure 4:
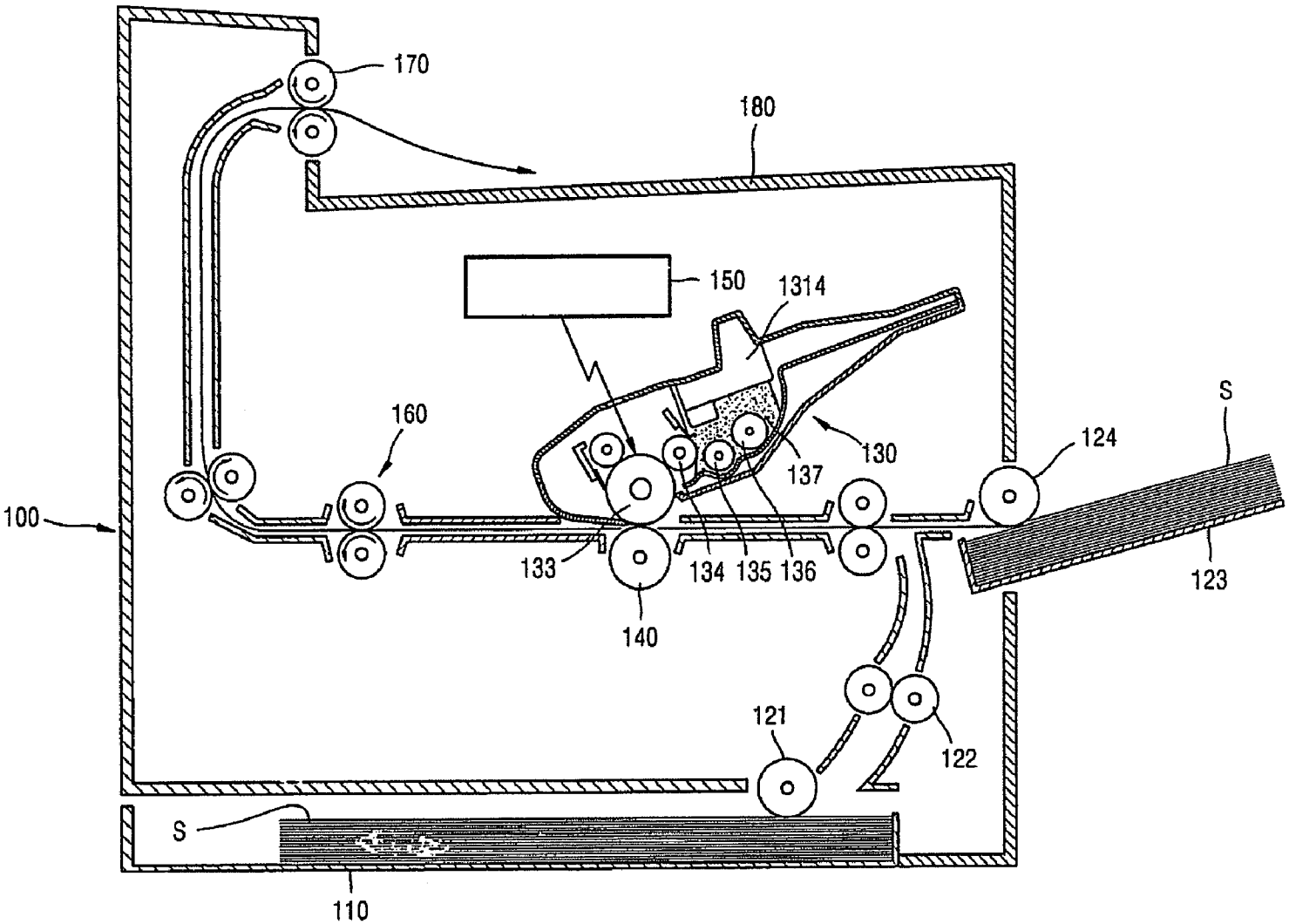
FIG. 4 is a longitudinal sectional view of an image forming apparatus having a developing device according to an exemplary embodiment of the present invention.
Figure 5:
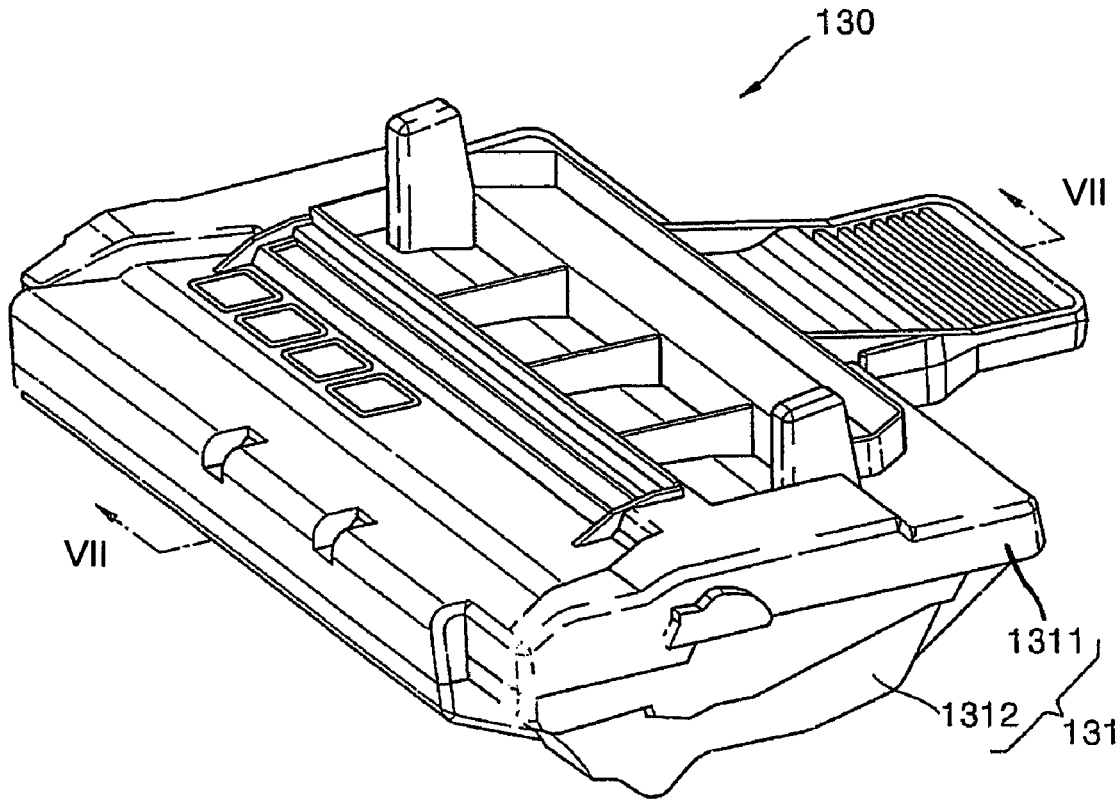
FIG. 5 is a perspective view of the image forming apparatus according to the exemplary embodiment of the present invention.
Figure 6:
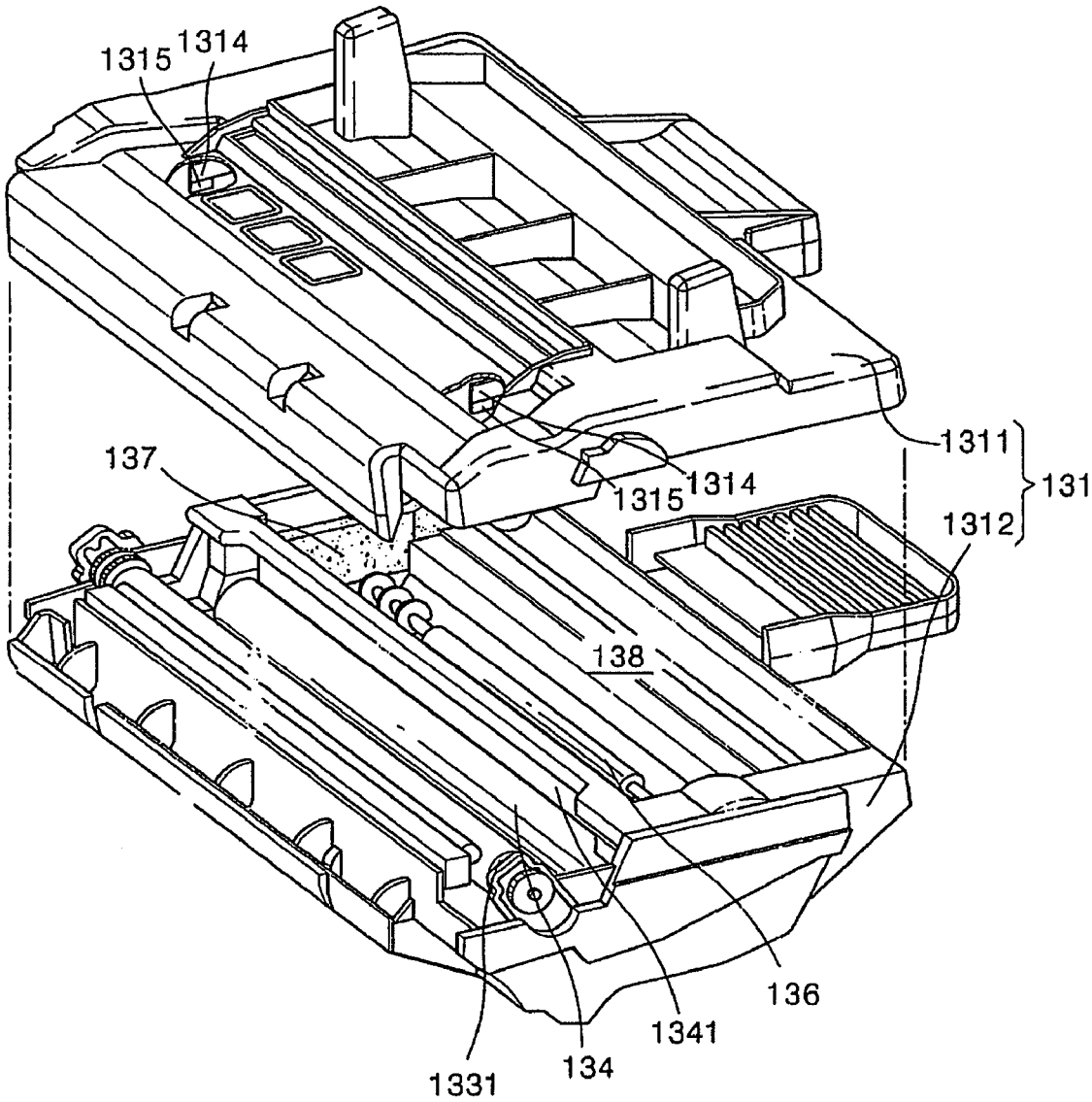
FIG. 6 is an exploded perspective view of the image forming apparatus according to the exemplary embodiment of the present invention.
Figure 7:
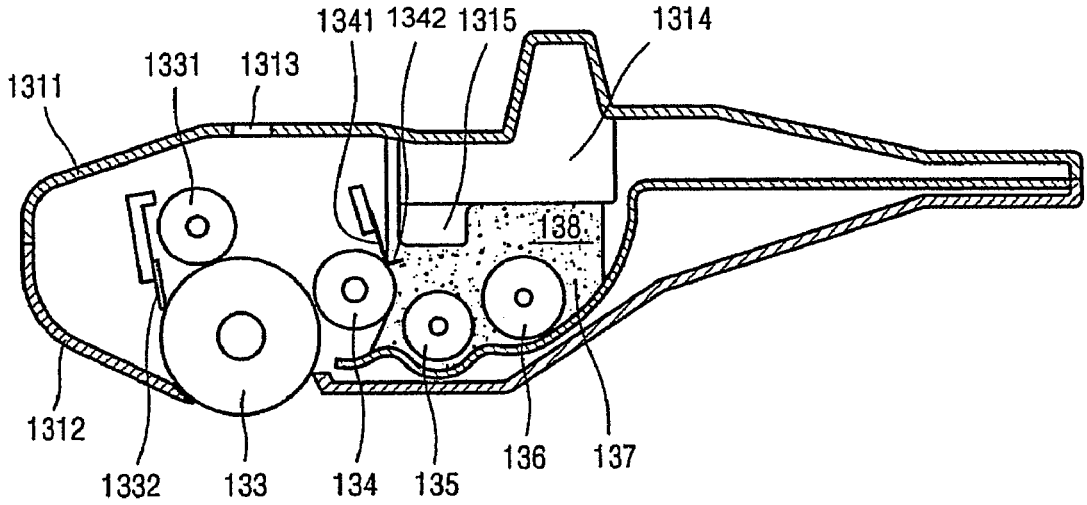
FIG. 7 is a longitudinal sectional view taken along line VII-VII of FIG. 5.
Figure 8:
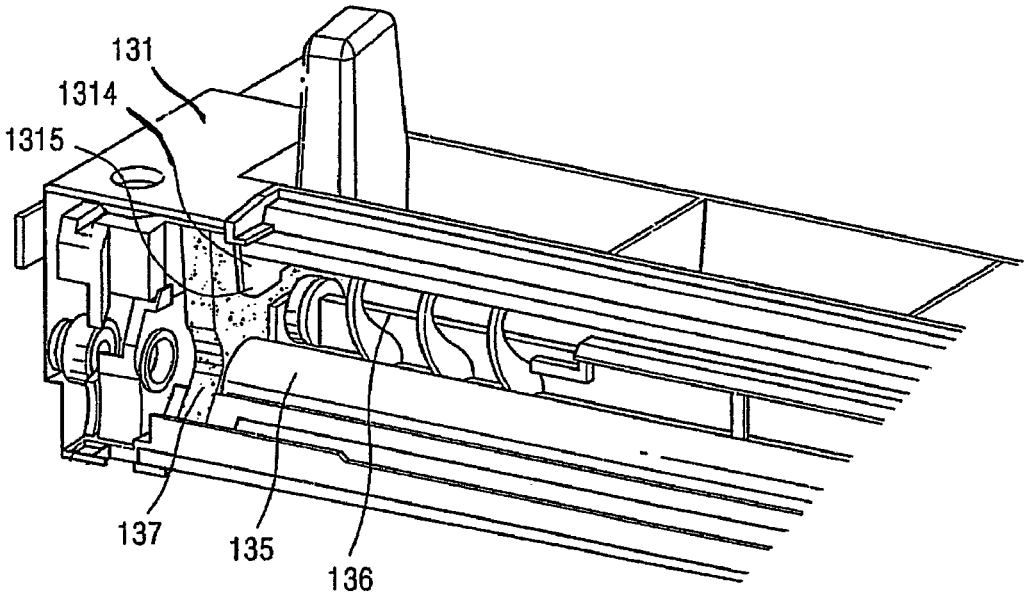
FIG. 8 is a perspective view of part of the image forming apparatus according to the exemplary embodiment of the present invention.

FIG. 4 is a longitudinal sectional view of an image forming apparatus having a developing device 130 according to an exemplary embodiment of the present invention, FIG. 5 is a perspective view of the image forming apparatus, FIG. 6 is an exploded perspective view of the image forming apparatus according to the exemplary embodiment of the present invention, FIG. 7 is a longitudinal sectional view taken along line VII-VII of FIG. 5, and FIG. 8 is a perspective view of part of the image forming apparatus according to the exemplary embodiment of the present invention.

Referring to FIG. 4, a cassette 110 is installed under a main body 100 of an image forming apparatus so that it is detachable from the main body 100 of the image forming apparatus. Recording media S are loaded in the cassette 110. A multipurpose paper feeder 123, in which recording media S are loaded, is installed at one side of the main body 100. Pickup rollers 121 and 124 are respectively installed above the cassette 110 and the multipurpose paper feeder 123 so that they respectively pick up a recording medium S loaded in the cassette 110 and a recording medium S loaded in the multipurpose paper feeder 123. Feed rollers 122 further urge medium S from the cassette 110 in the direction of the developing device 130.

The developing device 130, a transferring roller 140, a fusing device 160, and a discharging device 170 are sequentially installed along a transfer path, along which a recording medium S picked up by the pickup roller 121 or 124 is transferred.

The developing device 130, which is installed in the main body 100 in such a manner that it is detachable from the main body 100, forms a toner image by developing an electrostatic latent image, which is formed by an exposure unit 150 in response to a print signal, using a developing agent, such as toner.

The transferring roller 140 is installed facing toward the developing device 130 and transfers the toner image formed by the developing device 130 onto a recording medium S, which passes between the transferring roller 140 and the developing device 130, by pressing the recording medium S down on the developing device 130.

The fusing device 160 applies heat and pressure to the toner image transferred onto the recording medium S so that the corresponding toner image can be fused on the recording medium S.

The discharging device 170 discharges the recording medium S to outside the main body 100 such that the recording medium S is loaded in a discharged paper container 180.

Referring to FIGS. 4 through 8, the developing device 130 includes a housing 131, which includes an upper case 1311 and a lower case 1312, a photosensitive drum 133, which is rotatably installed in the housing 131, a developing roller 134, a toner supplying roller 135, an agitating roller 136, sealing elements 137, and fixing elements 1314.

The photosensitive drum 133 is formed by coating a metallic drum with a photosensitive material layer. The photosensitive drum 133 is rotatably installed in the lower case 1312 and is partially exposed through the housing 131. The photosensitive drum 133 is uniformly charged. When light is applied to the photosensitive drum 133 by the exposure unit 150, which is installed above the photosensitive drum 133, an electrostatic latent image is formed on the surface of the photosensitive drum 133. Here, light applied to the photosensitive drum 133 by the exposure unit 150 is determined based on predetermined image information. A through hole 1313, through which light radiated from the exposure unit 150 reaches the surface of the photosensitive drum 133, is formed in the upper case 1311.

A charging roller 1331 and a cleaning blade 1332 are installed on the outer circumferential surface of the photosensitive drum 133. When the photosensitive drum 133 rotates, the charging roller 1331 uniformly charges the outer circumferential surface of the photosensitive drum 133 while rotating together with the photosensitive drum 133 in contact with the photosensitive drum 133. The cleaning blade 1332 removes toner particles left on the surface of the photosensitive drum 133 after a toner image is transferred onto a recording medium S.

The developing roller 134 is rotatably installed in the lower case 1312 so that it comes into direct contact with the photosensitive drum 133 in the direction of the length of the photosensitive drum 133. The developing roller 134 supplies toner to the electrostatic latent image formed on the surface of the photosensitive drum 133. A regulating blade 1341 is installed over the developing roller 134. The regulating blade 1341 regulates the thickness of a toner layer attached on the surface of the developing roller 134 by sweeping excessive toner off the surface of the developing roller 134. Since the regulating blade 1341 enables a toner layer having a uniform thickness to be formed throughout the surface of the developing roller 134, a uniform amount of toner to the photosensitive drum 133 can be supplied to the photosensitive drum 133.

The toner supplying roller 135 is a predetermined distance apart from the developing roller 134 and is rotatably installed in the lower case 1312. The toner supplying roller 135 supplies toner to the developing roller 134. The toner supplying roller 135 rotates in the same direction as the developing roller 134.

The agitating roller 136 is rotatably installed in the lower case 1312, particularly, at a lower portion of a toner container 138. The agitating roller 136 prevents toner contained in the toner container 138 from solidifying.

The sealing elements 137 are respectively installed at both sides of the toner container 138, particularly, at both sides of the lower case 1312, in which the developing roller 134, the toner supplying roller 135, and the agitating 136 are rotatably installed. The sealing elements 137 prevent the toner contained in the toner container 138 from leaking from the toner container 138. As illustrated in FIG. 7, portions of the sealing elements 137 contact the developing roller 134, and an end 1342 of the regulating blade 1341 is inserted in the sealing elements 137. Accordingly, when the regulating blade 1341 sweeps excessive toner off the developing roller 134, the end 1342 of the regulating blade 1341 may be pulled out of the respective sealing elements 137. The end 1342 of the regulating blade 1341 may also be pulled out of the respective sealing elements 137 due to external shock.

Referring to FIGS. 6 through 8, the fixing elements 1314 are formed under the upper case 1311 to protrude toward the lower case 1312 and to be a predetermined distance apart from each other. The fixing elements 1314 fix the sealing elements 137 to the housing 131 by elastically pushing the sealing elements 137 toward the inner surface of the housing 131.

Supporting elements 1315 protrude downward from the fixing elements 1314 in the vicinity of the developing roller 134 and the regulating blade 1341. The supporting elements 1315 support the sealing elements 137, which contact the developing roller 134 and the regulating blade 1341.

Specifically, when the developing roller 134 rotates, and the regulating blade 1341 regulates the thickness of a toner layer formed on the developing roller 134, or when external shock is applied to the image forming apparatus, the supporting elements 1315 prevent the sealing elements 137 from being separated from the developing roller 134 and the regulating blade 1341 by elastically supporting portions of the sealing elements 137.

The larger the areas of the supporting elements 1315, the larger the areas of the sealing elements 137 supported by the fixing elements 1314. Thus, the supporting elements 1315 prevent the sealing elements 137 from swaying due to external shock by firmly supporting the sealing elements 137. Accordingly, the supporting elements 1315 can prevent toner from leaking out of the developing device 130 by preventing the sealing elements 137 from being separated from the developing roller 134 and the regulating blade 1341. Particularly, the supporting elements 1315 partially block toner supplied from the toner supplying roller 136 to the developing roller 134 and thus prevent the toner from reaching the surfaces of the sealing elements 137. Accordingly, the supporting elements 1315 can prevent the toner from leaking out of the developing device 130.

Each of the supporting elements 1315 and the corresponding fixing element 1314 are preferably, but not necessarily, integrated into one body. In addition, each of the supporting elements 1315 is preferably, but not necessarily, formed above the toner supplying roller 135. Portions of the sealing elements 137 above the toner supplying roller 135 are more likely to be separated from the developing roller 134 and the regulating blade 1341 than other portions of the sealing elements 137. Thus, the supporting elements 1315 can prevent the sealing elements 137 from being separated from the developing roller 134 and the regulating blade 1341 by supporting the portions of the sealing elements 137 above the toner supplying roller 135.

The supporting elements 1315 may be formed in various shapes as long as they can support portions of the sealing elements 137 contacting the developing roller 134 and the regulating blade 1341.

As described above, the developing device 130 according to the present invention has the following advantages. First, the developing device 130 according to the present invention can prevent toner from leaking therefrom due to external shock. Next, the developing device 130 according to the present invention can prevent toner from being transferred to either side of a developing roller 134 and of a toner supplying roller 135. Finally, the developing device according to the present invention can prevent toner from reaching the surfaces of sealing elements 137 by supporting the sealing elements 137 so that the sealing elements can be prevented from swaying due to external shock.

The foregoing is considered illustrative only of the principles of the invention. Further, since the numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. A developing device comprising:

a housing including therein a toner container, a developing roller having two sides and a regulating blade having two sides;

sealing elements, which are respectively formed at the two sides of the developing roller and the two sides of the regulating blade to prevent toner from leaking out of the toner container; and fixing elements, which fix the sealing elements in the housing so that the sealing elements cannot move, wherein each of the fixing elements includes a supporting element that supports the corresponding sealing element by pushing the corresponding sealing element toward the sides of the regulating blade and the developing roller so that the corresponding sealing element comes into contact with the sides of the regulating blade and the developing roller.

2. The developing device of claim 1, wherein the housing has an upper case and a lower case, and each of the fixing elements protrudes downward from the upper case to face the lower case, and each supporting element extends downward from the corresponding fixing element in the vicinity of the developing roller and the regulating blade.

3. The developing device of claim 2, further comprising a toner supplying roller, which supplies toner to the developing roller, wherein the supporting element is located above the toner supplying roller.

4. The developing device of claim 2, wherein each supporting element and the corresponding fixing element are formed as one body.

5. An image forming apparatus comprising:

a developing device, which develops an electrostatic latent image into a toner image;

a transferring device, which transfers the toner image onto a recording medium, and a fusing device, which fuses the toner image onto the recording medium:

wherein the developing device includes:

a housing including therein a toner container, a developing roller having two sides and a regulating blade having two sides;

sealing elements, which are respectively formed at the two sides of the developing roller and the two sides of the regulating blade to prevent toner from leaking out of the toner container; and fixing elements, which fix the sealing elements in the housing so that the sealing elements cannot move, wherein each of the fixing elements includes a supporting element that supports the corresponding sealing element by pushing the corresponding sealing element toward the two sides of the regulating blade and the two sides of the developing roller so that the corresponding sealing element comes into contact with the sides of the regulating blade and the developing roller.

6. The image forming apparatus of claim 5, wherein the housing has an upper case and a lower case, and each of the fixing elements protrudes downward from the upper case to face the lower case, and each supporting element extends downward from the corresponding fixing element in the vicinity of the developing roller and the regulating blade.

7. The image forming apparatus of claim 6, further comprising a toner supplying roller, which supplies toner to the developing roller, wherein the supporting element is located above the toner supplying roller.

8. The image forming apparatus of claim 6, wherein each supporting element and the corresponding fixing element are formed as one body.

9. A developing device comprising:

a housing including therein a toner container, a developing roller having two sides and a regulating blade having two sides;

sealing elements, which are respectively formed at the two sides of the developing roller and the two sides of the regulating blade to prevent toner from leaking out of the toner container; and protrusions extending from the housing end supporting the sealing elements by pushing each respective sealing element toward the sides of the regulating blade and the sides of the developing roller, so that the corresponding sealing element comes into contact with the sides of the regulating blade and the developing roller.

10. The developing device of claim 9, wherein the housing has an upper case and a lower case, and each of the protrusions extends downward from the upper case toward the lower case.

11. An image forming apparatus comprising:

a developing device, which develops an electrostatic latent image into a toner image;

a transferring device, which transfers the toner image onto a recording medium, and a fusing device, which fuses the toner image onto the recording medium;

wherein the developing device includes:

a housing including therein a toner container, a developing roller having two sides and a regulating blade having two sides;

sealing elements, which are respectively formed at the two sides of the developing roller and the two sides of the regulating blade to prevent toner from leaking out of the toner container; and protrusions extending from the housing and supporting the corresponding sealing element by pushing the corresponding sealing element toward the two sides of the regulating blade and the two sides of the developing roller, so that the corresponding sealing element comes into contact with the sides of the regulating blade and the developing roller.

12. The image forming apparatus of claim 11, wherein the housing has an upper case and a lower case, and each of the protrusions extends downward from the upper case toward the lower case.

* * * * *